US007112109B2

(12) United States Patent
Meyer

(10) Patent No.: US 7,112,109 B2
(45) Date of Patent: Sep. 26, 2006

(54) PROPULSION SYSTEM FOR SHIPS, IN PARTICULAR FOR CRUISE VESSELS

(76) Inventor: Peter Meyer, Im Felsing 36, D-26826 Weener (DE)

( * ) Notice: Subject to any disclaimer, the term of this patent is extended or adjusted under 35 U.S.C. 154(b) by 0 days.

(21) Appl. No.: 10/263,455

(22) Filed: Oct. 2, 2002

(65) Prior Publication Data

US 2003/0077955 A1 Apr. 24, 2003

(30) Foreign Application Priority Data

Oct. 5, 2001 (EP) ..... 01123884

(51) Int. Cl.
*B63H 25/06* (2006.01)
*B63H 25/42* (2006.01)

(52) U.S. Cl. ..... 440/51; 114/144 RE; 114/162

(58) Field of Classification Search ..... 440/6, 440/51, 53, 58, 59, 60; 114/144 R, 144 RE, 114/150, 162, 163, 164, 166
See application file for complete search history.

(56) References Cited

U.S. PATENT DOCUMENTS

| | | | | |
|---|---|---|---|---|
| 1,302,956 | A * | 5/1919 | Owen | 440/51 |
| 2,714,866 | A * | 8/1955 | Pleuger et al. | 440/6 |
| 3,798,525 | A * | 3/1974 | Cooper | 318/588 |
| 3,807,339 | A * | 4/1974 | Howells | 114/67 A |
| 3,996,877 | A * | 12/1976 | Schneekluth | 440/79 |
| 4,449,469 | A * | 5/1984 | Woolaver et al. | 114/150 |
| 4,493,660 | A * | 1/1985 | Becker et al. | 440/67 |
| 5,041,029 | A * | 8/1991 | Kulpa | 440/1 |
| 5,417,597 | A * | 5/1995 | Levedahl | 440/6 |
| 6,165,031 | A * | 12/2000 | Lonngren et al. | 440/51 |
| 7,013,820 | B1 * | 3/2006 | Sakamoto et al. | 114/144 R |
| 2003/0000444 | A1 * | 1/2003 | Tsuboguchi | 114/162 |
| 2004/0063363 | A1 * | 4/2004 | Drefs et al. | 440/6 |

FOREIGN PATENT DOCUMENTS

| | | | |
|---|---|---|---|
| DE | 19640481 | * | 5/1998 |
| JP | 6-56082 | * | 3/1994 |
| WO | 89/05262 | * | 6/1989 |

* cited by examiner

*Primary Examiner*—Sherman Basinger
(74) *Attorney, Agent, or Firm*—Friedrich Kueffner

(57) ABSTRACT

For avoiding a high permanent load of the main and control drives rotatable around the vertical axis for ships for the straight forward sailing by a small and compact course keeping rudder system provided for this purpose, for a propulsion system (10) for ships, in particular for cruise vessels (100) with combined main and control drives (20), in particular with at least one podded propulsor (25; 25'), whereby the drive and at least one propeller (26; 26') are combined in a rotatable gondel-type unit or gondel-type housing (27) placed outside the proper hull (110) in the stern area (115), at least one course keeping rudder system (30; 30') is placed outside the swivelling range of the podded propulsor (25) or of the podded propulsors (25; 25') in the stern area (115) of the hull (110) as an independent, separate, small and preferably electrohydraulically driven rudder configured with a flow favourable profile which makes available only the steering moments necessary for the ship during the straight forward travelling, preferably under course control operation (or autopilot operation), the main and control drives being unused during the straight forward travelling, no longer used and remaining in inoperative position.

6 Claims, 8 Drawing Sheets

PROPULSION SYSTEM FOR SHIPS, IN PARTICULAR FOR CRUISE VESSELS

BACKGROUND OF THE INVENTION

The invention relates to a propulsion system for ships, in particular for cruise vessels.

It is known to choose propulsion arrangements for ships, preferably for cruise/passenger vessels which make available the forces necessary for the ahead course as well as the transverse forces necessary for steering the ships during manoeuvres and/or for keeping the course in the stern area for constituting the steering moment around the vertical axis by corresponding control or regulating signals which act on the respective electro hydraulic steering gear/adjusting unit for the propulsion arrangement over a corresponding torsion about the respective system vertical axis.

For maintaining a most possible straight course of ships for long distance sailing, it is necessary to adjust the whole main drive or for twin propeller ships at least one of the two drives about the vertical axis so that a very small angle is obtained in the shortest time This is the only way to economically produce the transverse forces necessary for maintaining the straight forward traveling of the ship. In particular for cruise vessels, ship driving elements, known as podded propulsors, are used for which the drive, such as for example the electrical motor, the propeller and the gondel, are combined in an unit as a rotatable suspension which is placed outside the proper hull. The range of application of these podded propulsors concerns in particular ship types which are particularly appropriate for the diesel electric propulsion, such as for example passenger vessels or ice breakers, and particularly where a good manoeuvrability is necessary. Two systems are used presently for these podded propulsors. First, the single propeller with a separate excited electrical motor and air cooling and second, the tandem propeller with a permanently excited electrical motor and cooling of the housing. For single propellers, the differentiation is made between the thrust arrangement for which the propeller is placed behind the turning axis and the pull arrangement (propeller in front of the turning axis). All the podded propulsors have in common that at least one propeller and its drive are placed in a turnable gondel-type unit.

Inside such a combined main and control drive, i.e. for such podded propulsors, for long distance travelling the whole inert masses around the turning axis are to be accelerated and to be braked again purposefully for the precalculated small adjusting angle in order to be able to achieve a stable operation of the control circuit for the straight forward behaviour of the ship. This results in that, for the numerous course correction forces or steering moments required for the ship, it must be reached that the ship to steer avoids as far as possible additional movements around its vertical axis for an economical operation The lifetime of the bearing of the main and control drives integrated into the ship in the preferably high dynamically loaded small angle area is reduced in case of such an operation to the zero position and the valves, relays, switches and components required inside the system for the hydraulic adjustment around the vertical axis as well as the shipbuilding constructions for the integration of the podded propulsors are exposed to heavy wear which results from the system dynamics and from the lower fatigue strength under reversed stresses. The systems used for the safety and economy of such driven and/or controlled ships are very time-consuming and very expensive in case of care, maintenance and repair works since the elements and components are of difficult access what makes necessary in most of the cases a docking—which is not economical for the operator of the ship—with a corresponding loss of use.

SUMMARY OF THE INVENTION

Thus, the aim of this invention is to create a propulsion system for ships, in particular for cruise vessels, with combined main and control drives, in particular with at least one podded propulsor with which a high permanent load of the main and control drives rotatable around the vertical axis is avoided for long distance travelling by a small and compact course keeping rudder system especially provided for this purpose and an uneconomical making available of the steering moments as well as a corresponding reduction of the safety risk are avoided as well.

This aim is achieved for a propulsion system for ships according to the type indicated in the introduction with the features indicated in the present invention.

Accordingly, the invention consists for such a propulsion system for ships in that at least one course keeping rudder system is placed outside the swivelling range of the main and control drive or of the podded propulsor or of the podded propulsors in the stern area of the hull as an independent, separate, small and preferably electrohydraulically driven rudder configured with a flow favourable profile which makes available only the steering moments necessary for the ship during the straight forward travelling, preferably under course control operation (or autopilot operation), the main and control drives being unused during the straight forward travelling, no longer used and remaining in inoperative position.

The advantages achieved with such a propulsion system configured according to the invention consist in particular in that, for long distance travelling of the ship, the main and control drives produce economically and safely the forward thrust for the straight forward travelling and steadily introduce into the ship and, completely independenty therefrom, one or eventually several separate course keeping rudder systems, exclusively optimized for this purpose, receive their control or regulation signals directly from the course controller or set-point adjuster (auto pilot) for small rudder angles and let act the corresponding steering moments onto the ship quickly, precisely and economically by means of the correspondingly operated course keeping rudder. Furthermore, there result the further advantages:

- For course keeping rudder systems, small systems are used which allow a large-scale economical production and assembly, have low energy and space requirements; all common systems can be used as course keeping rudder systems.
- They are easily and simply electrically drivable.
- Maintainable and attendable without docking.
- Avoiding of switch induced peaks in the ship network for long distance travelling because of the much lower power requirement when the course keeping rudder systems are used.
- Considerable reduction of the additional resistance due to manoeuvers for the whole ship system for long distance travelling.
- Optimally adjustable stationary slight spreading of the main and control drives for the best possible use of energy for making available thrust in lengthwise direction for long distance travelling for different profiles of use after successful sea trial trip and depending on the real conditions of use by the ship operation specialists on board.

For lower ship speeds during manoeuvring, in shallow waters, harbours, channels, the very powerful podded propulsors are then used as main and control drives solely or together with the bow thrusters while the course keeping rudder system(s) remain in their position zero.

Ships with one or several podded propulsors can be backfitted at any time even for already constructed ships.

The arrangement of the course keeping rudder systems takes place in the wake of the respective ship.

The number of the course keeping rudder systems depends respectively on the size of the vessel and on the number of the podded propulsors. Each course keeping rudder system is used in priority for long distance travelling facing the podded propulsor or podded propulsors, whereby it is particularly advantageous if the course keeping rudder system or systems placed behind the podded propulsor is/are integrated into the after-body of the hull laterally offset to the pod propulsor(s).

The course keeping rudder systems are used during the long distance travelling of the ship. For this purpose, they receive their control signals either by manual control from the ship conductor over the course controller (autopilot system) or time- or path-dependently from the bridge desk (control stands). According to a further configuration, it is also possible to obtain the excitation of the course keeping rudder gears automatically over the measure of the ship speed from a speed to be preselected and/or to be adjusted with the above mentioned set-point adjusters. Always when the course keeping rudder gears are used—as during straight ahead sailing at higher speeds or also in cases of track control—the main and control drives are turned first into their predetermined zero positions and remain there stationary as long as the ship conductor orders purposefully "manoeuvre operation" or for example also "emergency operation" with priority control (override), what immediately results through the adjustment of the main and control drives in the necessary angles with the corresponding control effect for the ship.

SHORT DESCRIPTION OF THE DRAWINGS

Embodiments of the invention are represented in the drawings.

DESCRIPTION OF THE PREFERRED EMBODIMENT

Figure 1:
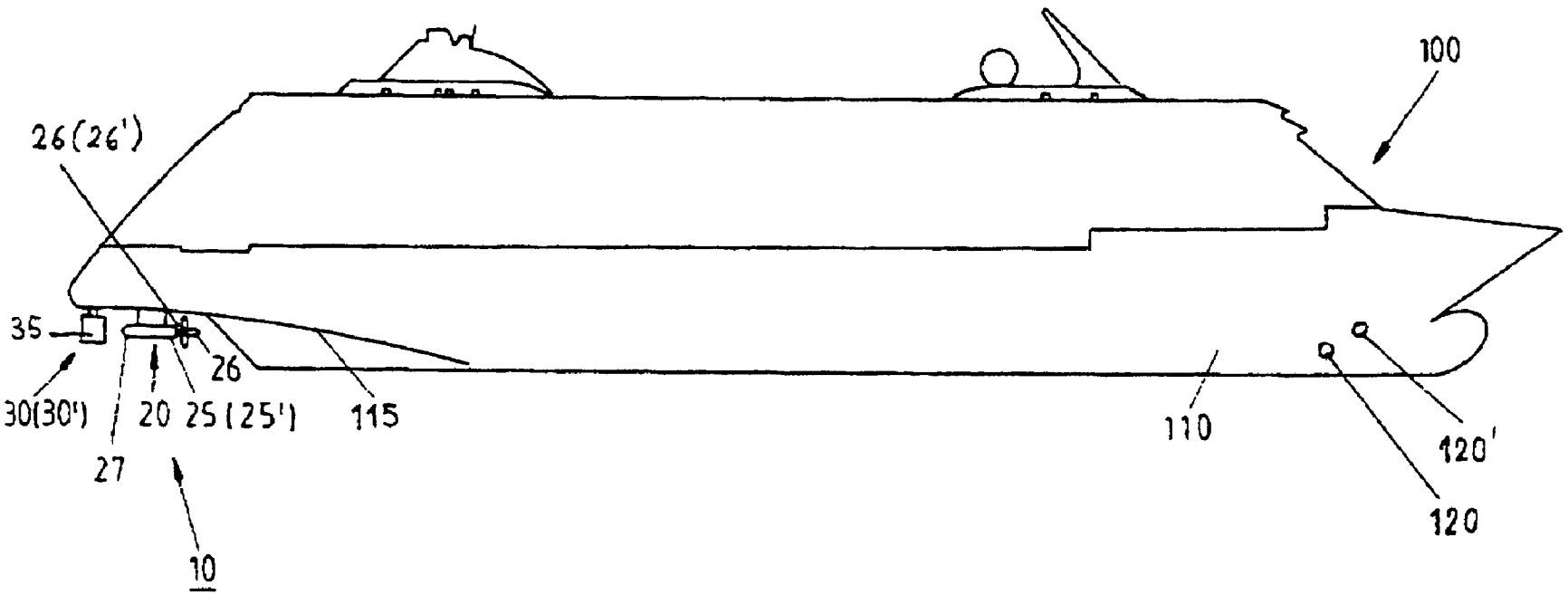
FIG. 1 shows in a schematic side view a ship with a main and control drive placed in the stern area in form of a podded propulsor and with a course keeping rudder system excited independently and placed behind it.
Figure 2:
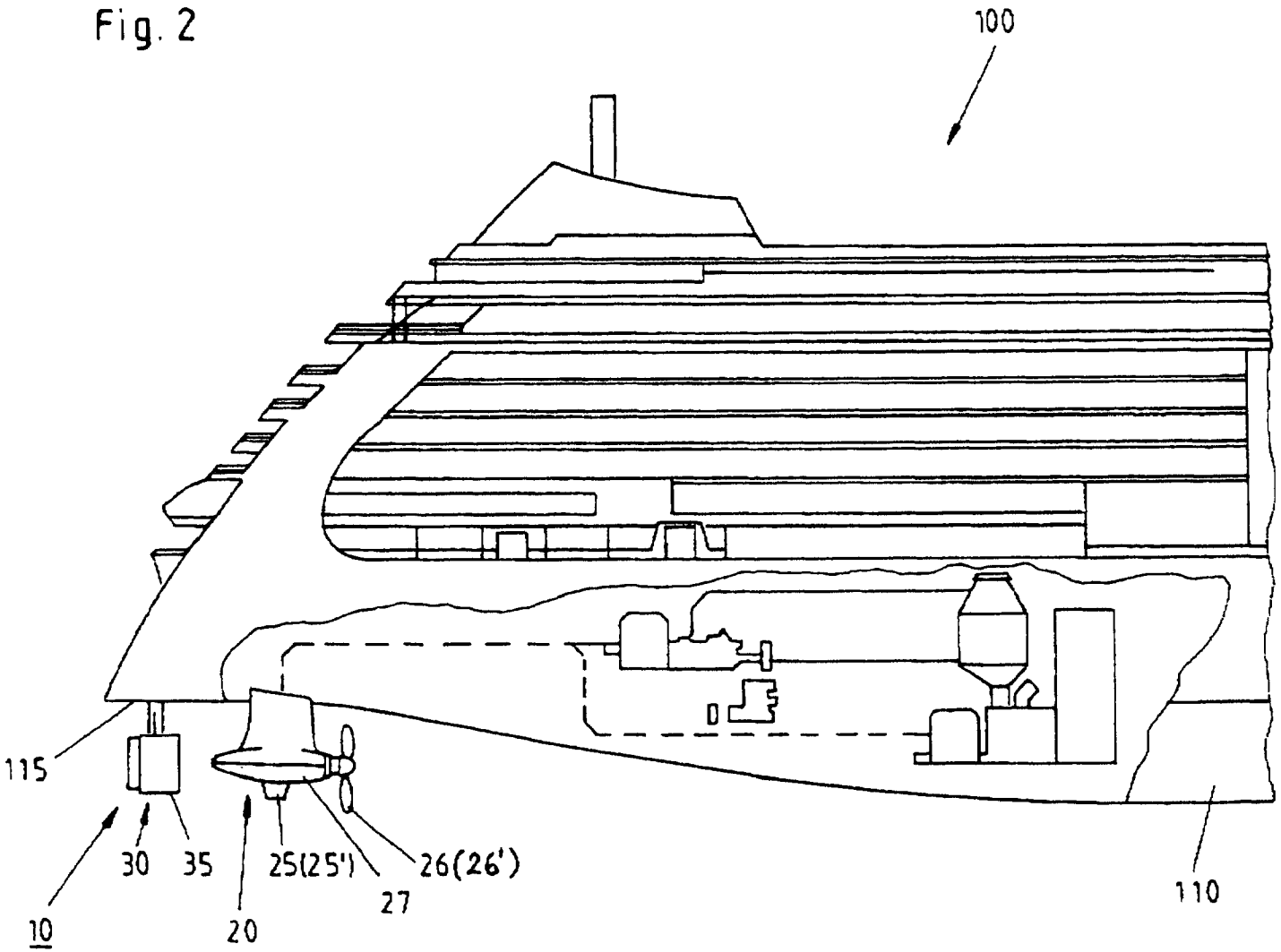
FIG. 2 shows an enlarged side view of the after-body with the main and control drive and the course keeping rudder system placed behind it.
Figure 3:
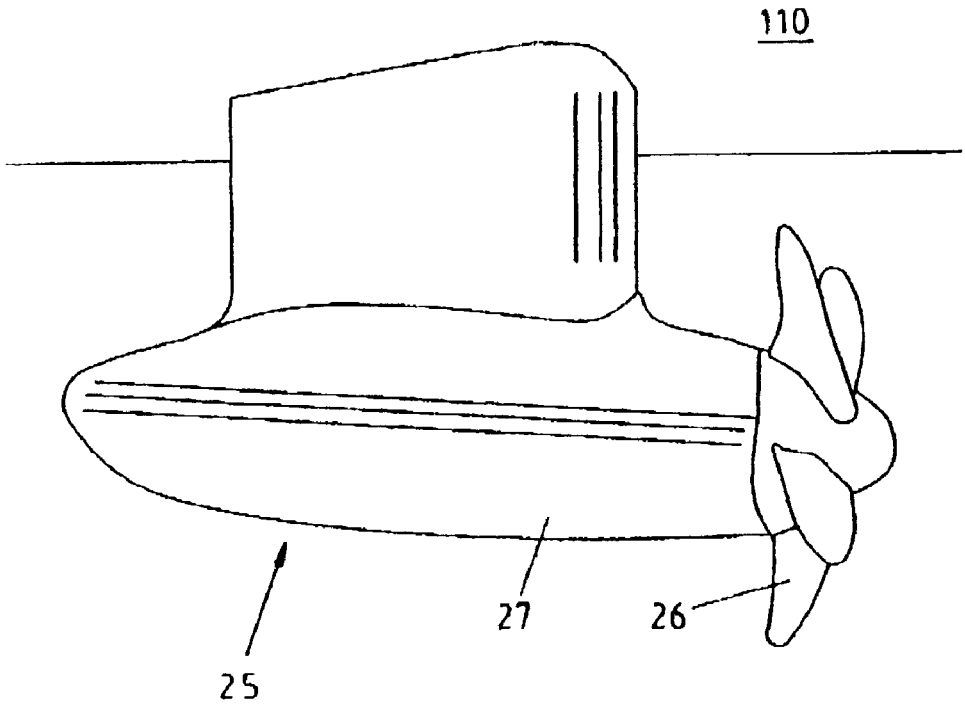
FIG. 3 shows an enlarged representation of a podded propulsor with a propeller.

The propulsion system according to the invention 10 represented in FIG. 1 and 2 for ships, in particular for cruise vessels 100, shows for example in the stern area 115 of the hull 110 two main and control drives 20, 20' which are configured as podded propulsors 25, 25'. For the embodiment shown in FIG. 3, a propeller 26 is provided for on a gondel-type housing 27 which receives the propeller drive and which is placed rotatable on the hull 110 of the stern area 115. This podded propulsor 25 is configured in a way known in itself. Preferably two bow thrusters 120, 120' are provided on the bow side in the hull 110.

Furthermore, the propulsion system 10 has at least one course keeping rudder system 30 which is placed outside the swivelling range of the podded propulsor 25 and independently from this in the stern area 115 of the hull 110 favourably to the flow. For this course keeping rudder system 30, it is a separate small and preferably electrohydraulic rudder 35, working independently from the podded propulsor and configured with a profile favourable to the flow which makes available only the steering moments necessary for the ship during the straight forward sailing, preferably under course control operation, the main and control drives 20 being no longer used, unused during the straight forward sailing and remaining in inoperative position. This course keeping rudder system 30 is configured in a way known in itself. Here, any type of rudder systems can be used, for example among others also profiled rudders with a hinged fin. Rudders comprising a main rudder and a fin hinged to it, controlled by the main rudder can also be used. All known steering gears are appropriate as electrohydraulic drives, such as for example of cylinder, plunger piston or rotating wing type, although drive systems configured in another manner can also be used.

Figure 4:
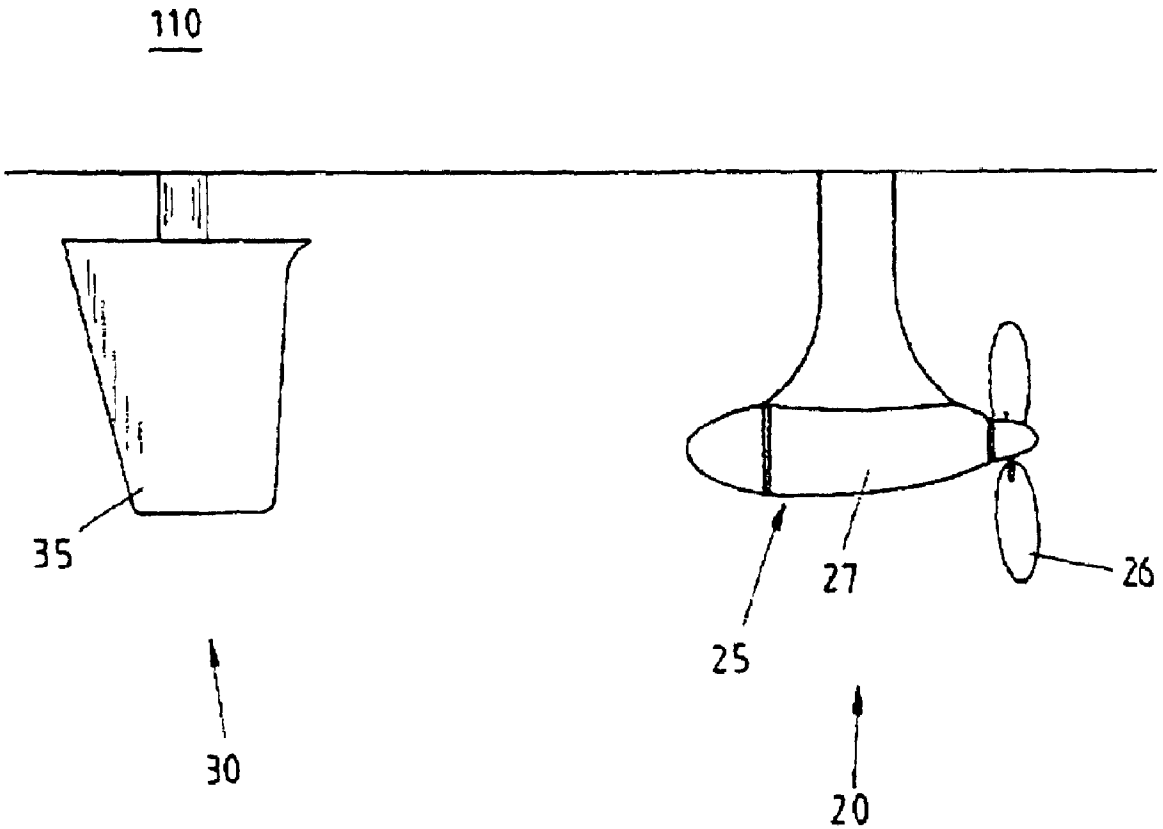
FIG. 4 shows in a schematic side view the podded propulsor with a propeller and with a course keeping rudder system placed behind it.

As shown in FIG. 4, the course keeping rudder system 30 is placed behind a podded propulsor 25 with a propeller 26.

Figure 5:
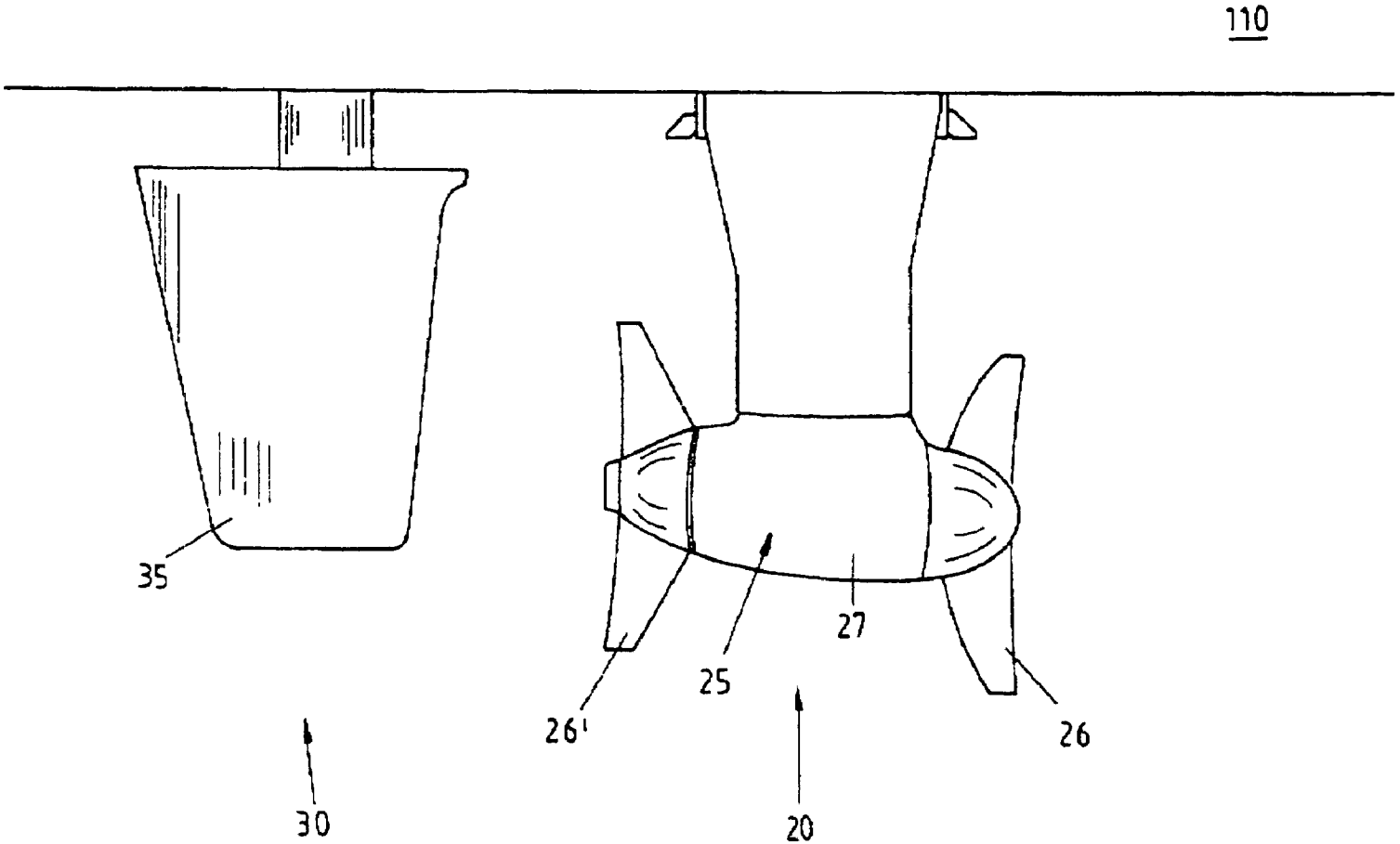
FIG. 5 shows a graphical view of the after-body of a ship with two podded propulsors and with a course keeping rudder system placed in the middle of it.
Figure 7:
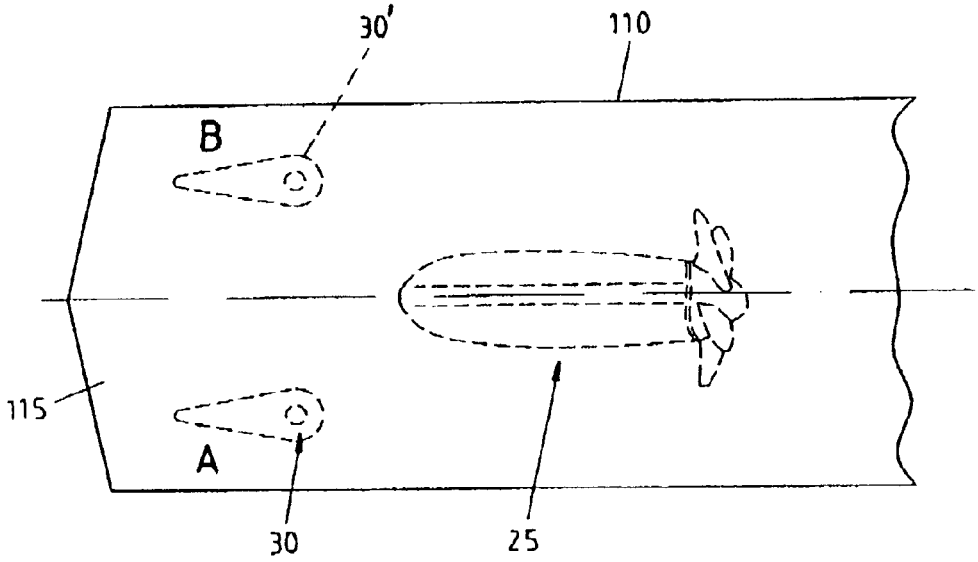
FIG. 7 shows schematically a view of a whole system made of two podded propulsors with course keeping rudder systems placed behind them.
Figure 8:
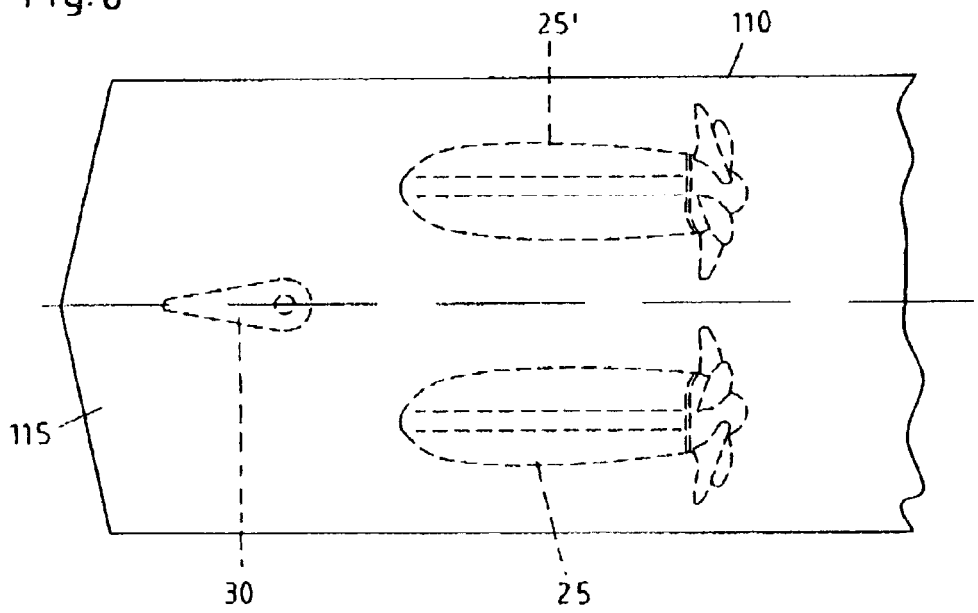
FIG. 8 is a view as in FIG. 5 with two course keeping rudder systems.
Figure 9:
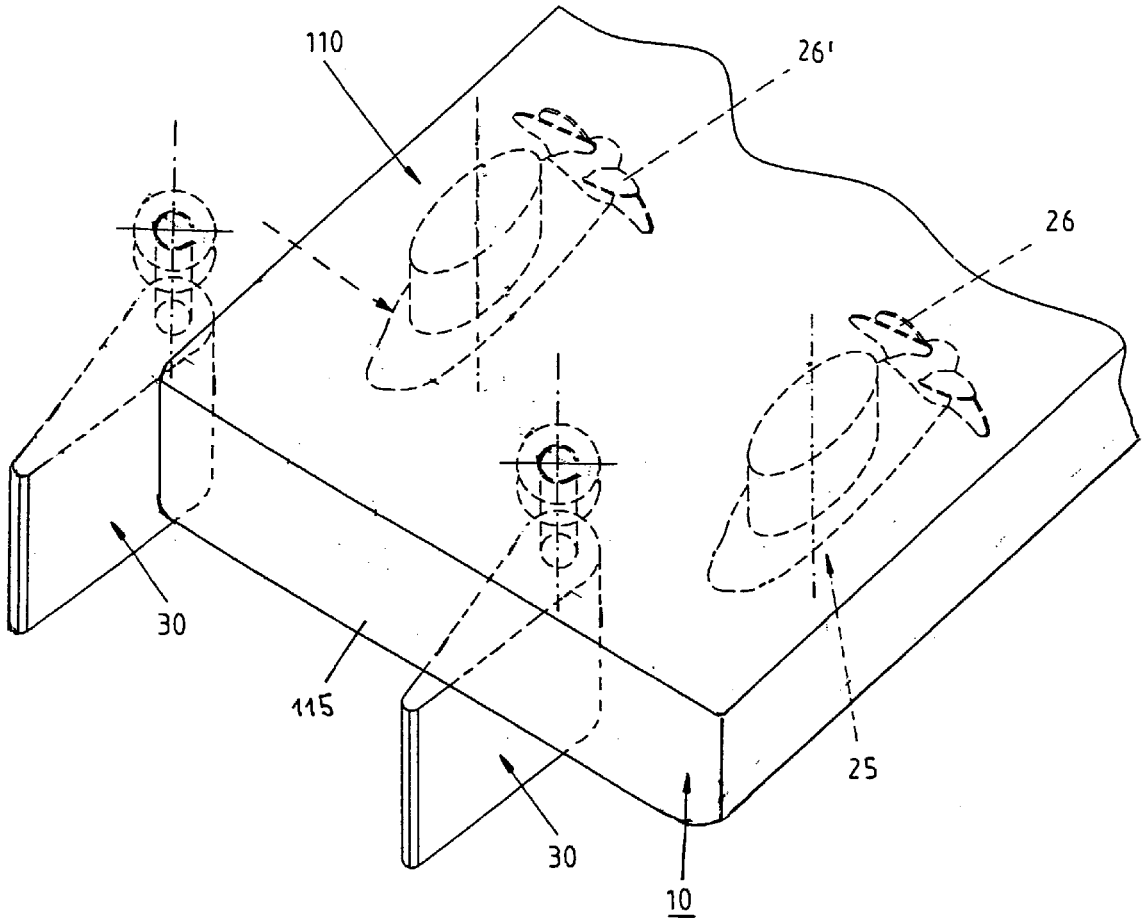

If two podded propulsors 25, 25' are placed in the stern area 115 of the hull 110 according to FIG. 5, the course keeping rudder system 30 is placed in the middle of both podded propulsors 25, 25' and behind these (FIG. 5 and 7).

Figure 6:
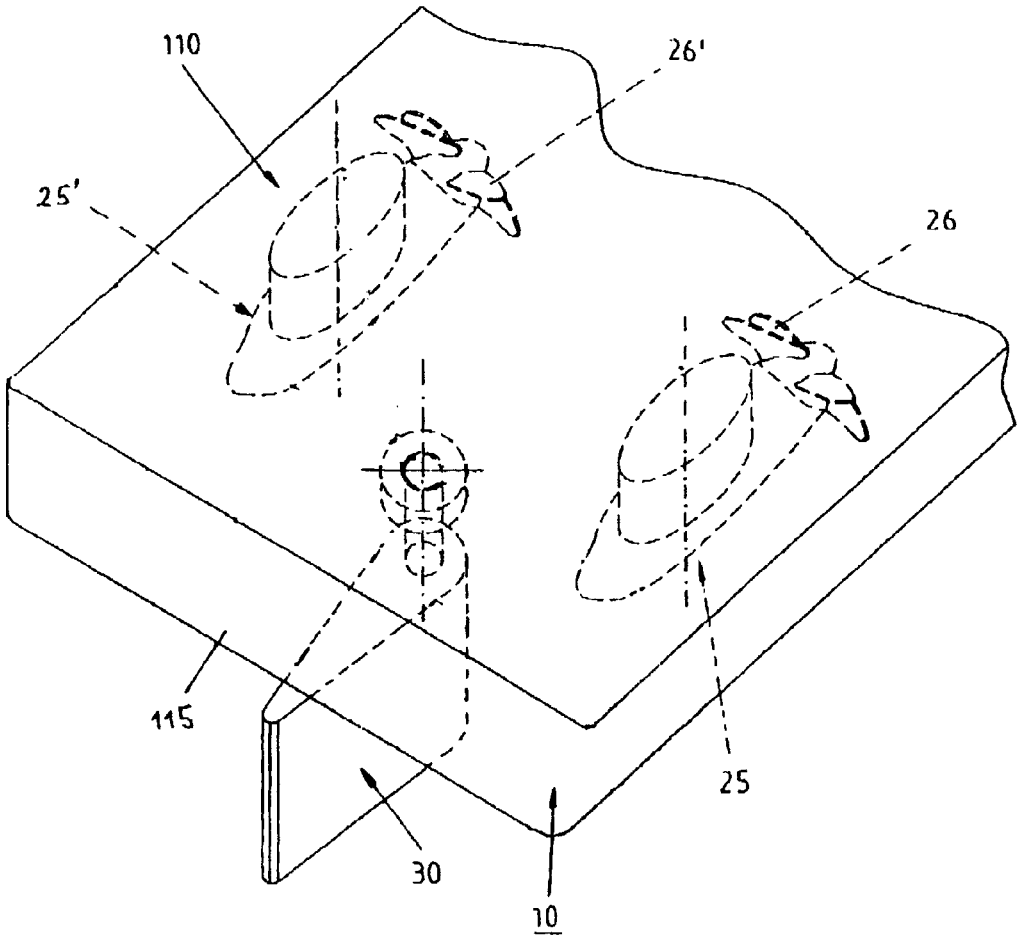
FIG. 6 shows schematically a semiplan view of the correspondence of a course keeping rudder system with a podded propulsor.

In case of only one podded propulsor 25, the course keeping rudder system 30 is placed behind the prodded propulsor, however laterally offset, as indicated in FIG. 6 by A and B.

For the long distance sailing of a ship, the main and control drives 20 produce the thrust for the straight forward sailing. The course keeping rudder system(s) working independently from the main and control drive(s) 20 give(s) the control signals which are directly received by the course controller or set-point ajuster (autopilot system) are directly converted by rudder blade incidence and transverse forces caused by this and the thus resulting steering moments for the ship. Thus, the podded propulsors are discharged during this operative use during a long distance sailing of the ship and no major change forces or moments around the turning axes act on these podded propulsors.

What is claimed is:

1. A ship with a navigation arrangement, with combined main propulsion and control/steering drives (20), with at least one podded propulsor (25, 25'), whereby the propulsion and control/steering drive and at least one propeller (26; 26') are combined in a rotatable gondel-type unit or gondel-type housing (27) placed outside the proper hull (110) in the stern area (115) so as to permit drive and steering of the ship, wherein at least one course keeping rudder system (30) is placed outside the swiveling range of the podded propulsor (25) or of the podded propulsors (25;25') in the stern area (115) of the hull (110) as an independent, separate, small and electrohydraulically operated rudder (35) configured with a flow favourable profile and operative to only provide the sole steering moments necessary for the ship during the straight forward traveling, the main and control/steering drives (20) being used for the straight forward traveling and low-speed steering, and unused for steering during the straight forward traveling, wherein each course keeping rudder system (30; 30') receives individually, independently and/or together simultaneously the control signals necessary for the course keeping of the ship from a course controller and the main and control/steering drives produce solely the forward thrust for the ship, wherein the propeller of the podded propulsor is faced away from the rudder.

2. A ship according to claim 1, wherein the course keeping rudder system (30) is placed behind the podded propulsor (25).

3. A ship according to claim 1, wherein more than one course keeping rudder system is provided, a respective course keeping rudder system (30) being assigned to each podded propulsor (25; 25').

4. A ship according to claim 1, wherein the course keeping rudder system or the course keeping rudder systems (30) placed behind the podded propulsor (25; 25') are laterally offset to the podded propulsor or the podded propulsors (25; 25') in the stern area (115) of the hull (110).

5. A ship according to claim 4, wherein the course keeping rudder system or the course keeping rudder systems (30) is placed outside the propeller thrust area of the podded propulsor (25; 25').

6. A ship according to claim 1, wherein for two podded propulsors (25; 25') the course keeping rudder system (30) is placed in the middle of the two podded propulsors (25; 25').

* * * * *